US010226927B2

(12) United States Patent
Kozai

(10) Patent No.: US 10,226,927 B2
(45) Date of Patent: Mar. 12, 2019

(54) METHOD FOR MANUFACTURING DROPLET-DISCHARGE HEAD SUBSTRATE AND DROPLET-DISCHARGING HEAD

(71) Applicant: Konica Minolta, Inc., Chiyoda-ku, Tokyo (JP)

(72) Inventor: Hiroaki Kozai, Tachikawa (JP)

(73) Assignee: KONICA MINOLTA, INC., Tokyo (JP)

( * ) Notice: Subject to any disclaimer, the term of this patent is extended or adjusted under 35 U.S.C. 154(b) by 762 days.

(21) Appl. No.: 14/764,753

(22) PCT Filed: Jan. 21, 2014

(86) PCT No.: PCT/JP2014/051034

§ 371 (c)(1),
(2) Date: Jul. 30, 2015

(87) PCT Pub. No.: WO2014/119418

PCT Pub. Date: Aug. 7, 2014

(65) Prior Publication Data

US 2015/0367645 A1 Dec. 24, 2015

(30) Foreign Application Priority Data

Jan. 30, 2013 (JP) ..... 2013-014909

(51) Int. Cl.
*B41J 2/16* (2006.01)

(52) U.S. Cl.
CPC ..... *B41J 2/16* (2013.01); *B41J 2/161* (2013.01); *B41J 2/1623* (2013.01)

(58) Field of Classification Search
CPC ..... B41J 2/16; B41J 2/161; B41J 2/1623
(Continued)

(56) References Cited

U.S. PATENT DOCUMENTS 3,444,608 A * 5/1969 Conn, Jr. ..... B21D 47/00 228/118
4,780,957 A * 11/1988 Shiga ..... H05K 3/0061 174/266

(Continued)

FOREIGN PATENT DOCUMENTS

EP 1693206 A1 8/2006
JP H11300972 A 11/1999

(Continued)

OTHER PUBLICATIONS

Extended European Search Report corresponding to Application No. 14746022.4-1701/2952351 PCT/JP2014051034; dated Aug. 3, 2017.

(Continued)

*Primary Examiner* — Michael N Orlando
*Assistant Examiner* — Elizabeth Bradford
(74) *Attorney, Agent, or Firm* — Cantor Colburn LLP

(57) ABSTRACT

An embodiment method for manufacturing a droplet-discharging head substrate may include a first step to perform a surface activation process on joint surfaces of first and second plates with an atom beam, ion beam or plasma; a second step to align and stack the first and second plates in such a manner that nozzle holes formed in the first plate communicate with through-holes formed in the second plate; and a third step to bond the joint surfaces of the stacked first and second plates by atomic bonding without covalent bonding caused by ion movement. The third step bonds the joint surfaces by bringing a load member into contact with the droplet-discharging surface of the first plate at a position away from the nozzle holes to apply pressure under an atmospheric pressure and by bringing the joint surfaces close to each other with an electrostatic attractive force.

10 Claims, 8 Drawing Sheets

(58) Field of Classification Search
USPC ..... 156/272.6
See application file for complete search history.

(56) References Cited

U.S. PATENT DOCUMENTS

| | | | | |
|---|---|---|---|---|
| 6,610,582 | B1 | 8/2003 | Stewart | |
| 7,416,010 | B2 * | 8/2008 | Byun | B32B 37/10 156/580 |
| 2006/0268063 | A1 * | 11/2006 | Inaoka | B29C 65/7841 347/54 |
| 2007/0111471 | A1 * | 5/2007 | Okada | B81C 3/001 438/455 |
| 2010/0013891 | A1 * | 1/2010 | Matsuo | B41J 2/1612 347/47 |
| 2010/0206475 | A1 * | 8/2010 | Ueno | B41J 2/161 156/274.4 |
| 2015/0209857 | A1 * | 7/2015 | Blacket | B21J 15/027 156/64 |

FOREIGN PATENT DOCUMENTS

| | | | |
|---|---|---|---|
| JP | 2003318217 | A | 11/2003 |
| JP | 2004003950 | A | 1/2004 |
| JP | 2005187321 | A | 7/2005 |
| JP | 2006297652 | A | 11/2006 |
| JP | 2009066795 | A | 4/2009 |
| JP | 2009105254 | A | 5/2009 |
| JP | 2009292004 | A | 12/2009 |
| WO | 2009008310 | A1 | 1/2009 |

OTHER PUBLICATIONS

International Search Report corresponding to Application No. PCT/JP2014/051034; dated Feb. 18, 2014, with English abstract.

International Preliminary Report on Patentability and Written Opinion issued by the International Searching Authority for corresponding Application No. PCT/JP2014/051034; dated Aug. 4, 2015; with English Translation.

* cited by examiner

METHOD FOR MANUFACTURING DROPLET-DISCHARGE HEAD SUBSTRATE AND DROPLET-DISCHARGING HEAD

CROSS REFERENCE TO RELATED APPLICATIONS

This is the U.S. national stage of application No. PCT/JP2014/051034, filed on Jan. 21, 2014. Priority under 35 U.S.C. § 119(a) and 35 U.S.C. § 365(b) is claimed from Japanese Application No. 2013-014909, filed Jan. 30, 2013, the disclosure of which is also incorporated herein by reference.

TECHNICAL FIELD

The present invention relates to a method for manufacturing a droplet-discharging head substrate and a droplet-discharging head to discharge liquid from nozzle holes.

BACKGROUND ART

In recent years, a so-called droplet-discharging technology is used for print apparatuses, such as printers, and deposition apparatuses for manufacturing semiconductor devices. The droplet-discharging technology allows discharge and throw of droplets, such as ink and deposition material for deposition apparatuses, onto targets.

Enhanced quality of printed images or accuracy of deposition is expected for such a droplet-discharging technology, and accordingly, droplet-discharging heads used for the droplet-discharging technology should have discharge characteristics that enable accurate ejection of very small droplets onto targets. Further, in accordance with recent reduction in size and increase in resolution of droplet-discharging heads, there has been a need for droplet-discharging heads having high-density nozzles to discharge droplets and at the same time having good discharge characteristics. The manufacture of droplet-discharging head substrates with high-density nozzle holes requires high processing accuracy for alignment and bonding of the plates constituting the substrates.

An example of such droplet-discharging head substrates is shown in FIG. 1, which is an exploded perspective view of a droplet-discharging head. The droplet-discharging head substrate 2 is constituted of a nozzle plate 21, an intermediate plate 22, and a body plate 23. The nozzle plate 21 has high-density nozzle holes 211. The intermediate plate 22 has communication holes 221 to communicate with the respective nozzle holes 211 to form flow paths. The body plate 23 has flow paths to communicate with the respective through-holes individually and has pressure chambers communicating with the flow paths and having piezoelectric elements 234 to discharge droplets at relevant positions. Accurate bonding of these plates is necessary for the discharge head to have good discharge characteristics.

A conventional method for bonding the plates uses an adhesive agent to bond the joint surfaces to each other. Bonding with an adhesive agent, however, has a risk that the adhesive agent may cover the openings formed in the plates and thus may affect the discharge characteristics. Such a risk is especially high for a droplet-discharging head substrate having high-density openings, such as nozzle holes and flow paths.

In view of this, there have been bonding methods without using an adhesive agent, such as anodic bonding and surface activated bonding where the surfaces of members are activated at a lower temperature than in anodic bonding for bonding the surfaces to each other.

The anodic bonding is a method using covalent bonding caused by the movement of cation contained in a glass plate. Such a method can bond members tightly without the need for an adhesive agent as disclosed in, for example, Patent Literature 1. In the case of formation of a droplet-discharging head by bonding an Si plate and glass member by anodic bonding as in Patent Literature 1, a high temperature of 300° C. or higher needs to be applied for cation movement while joint surfaces are softened and brought closed to each other.

The surface activated bonding is a method where the joint surfaces of a silicon substrate and a glass substrate are irradiated with an atom beam, an ion beam, or a plasma as an energy wave to be activated for OH or ON groups to be added to the joint surfaces and then the substrates are bonded to each other by atomic bonding between the substrates. Similarly to the anodic bonding, the surface activated bonding can bond joint surfaces with each other without using an adhesive agent as disclosed in Patent Literature 2. Instead of the ion movement requiring a high temperature as in the anodic bonding, the surface activated bonding needs to press the plates against each other with a high pressure while softening the joint surfaces under the above-mentioned low temperature for the joint surfaces to come close to and bond to each other.

PRIOR ART LITERATURES

Patent Literatures

Patent Literature 1: Japanese Unexamined Patent Application Publication No. 2005-187321

Patent Literature 2: Japanese Unexamined Patent Application Publication No. 2003-318217

DISCLOSURE OF INVENTION

Problems to be Solved by the Invention

In typical anodic bonding as used in Patent Literature 1, a combination of direct-current high voltage application and high-temperature heating is necessary to soften joint surfaces, to bring the joint surfaces into tight contact with each other, and to cause cation movement as described above. Specifically, while the plates are in contact with each other, a direct-current high voltage is applied with the glass plate side being a cathode, and a high temperature of about not less than 300° C. and not more than 500° C. is applied. FIG. 9 is a graph showing levels of cation movement under the temperatures of 200° C. and 300° C. and under an atmospheric pressure. The vertical axis of the graph of FIG. 9 represents the current generated by cation movement. The flow of current indicates occurrence of cation movement which indicates anodic bonding. The graph shows that a current of 0 μA flows, which means no cation movement occurs, under the temperature of 200° C. The graph thus shows that a temperature of about 200° C. could not achieve anodic bonding that requires cation movement.

The technique of Patent Literature 1 performs surface activated bonding as temporary bonding and then performs anodic bonding as main bonding. Such a method can make the temperature for anodic bonding lower than in the case of using anodic bonding alone. The technique of Patent Literature 1 nevertheless applies a high temperature of about not less than 200° C. and not more than 400° C. When plate members with high-density multiple openings, such as nozzle holes, are to be bonded to each other to form a droplet-discharging head, such a high temperature causes problems of deformation of the openings and breakages and warps of the plate members. It is thus difficult to perform bonding without impairing the discharge performance as described above.

The surface activated bonding described in Patent Literature 2 can perform bonding at a further lower temperature than in the case of the anodic bonding described in Patent Literature 1. Such surface activated bonding, however, gives rise to a problem when it is applied not to the bonding of wafer members as described in Patent Literature 2, but to the bonding of plate members having high-density multiple openings, such as nozzle holes, to form a droplet-discharging head substrate. That is, when a direct contact is made to the whole surface of a plate member for a droplet-discharging head substrate having high-density openings, such as nozzle holes, and a high pressure is applied to the surface, the nozzle holes may be damaged, broken or cracked. It is therefore difficult to employ the surface activated bonding for the droplet-discharging head substrate.

It is an object of the present invention to provide a bonding method that can bond stacked plates to each other to manufacture a droplet-discharging head substrate without damaging nozzle holes and without impairing a good discharge performance.

Means for Solving Problems

In order to solve the above-described problems, a first aspect of the present invention is a method for manufacturing a droplet-discharging head substrate, the substrate including: a first plate having a plurality of nozzle holes to discharge droplets; and a second plate bonded to, of the first plate, a surface opposite to a droplet-discharging surface from which the droplets are discharged, the second plate having a plurality of through-holes communicating with the respective nozzle holes to form a plurality of flow paths, the method including: a first step to perform a surface activation process on joint surfaces of the first and second plates with an atom beam, an ion beam, or a plasma as an energy wave; a second step to align and stack the first and second plates in such a manner that the nozzle holes formed in the first plate communicate with the respective through-holes formed in the second plate; and a third step to bond the joint surfaces of the stacked first and second plates to each other by atomic bonding without covalent bonding caused by ion movement, wherein the third step bonds the joint surfaces by bringing a load member into contact with the droplet-discharging surface of the first plate at a position away from the nozzle holes and applying a pressure to the droplet-discharging surface under an atmospheric pressure, and by bringing the joint surfaces close to each other with an electrostatic attractive force generated between the joint surfaces.

In a second aspect, a sum of a load applied in the third step of the first aspect is within a range of not less than 0.196 N and not more than 4.90 N.

In a third aspect, the third step of the first or second aspect is performed under a temperature of not less than 100° C. and not more than 200° C.

In a fourth aspect, the first plate of the first to third aspects is made of silicon, the second plate is made of glass, and the first and second plates each have a thickness of not less than 100 μm and not more than 300 μm.

In a fifth aspect, the droplet-discharging surface of the first plate of the first to fourth aspects has a liquid-repellent film formed thereon.

A sixth aspect of the present invention is a method for manufacturing a droplet-discharging head, the head including: a first plate having a plurality of nozzle holes to discharge droplets; a second plate bonded to, of the first plate, a surface opposite to a droplet-discharging surface from which the droplets are discharged, the second plate having a plurality of through-holes communicating with the respective nozzle holes to form a plurality of flow paths; and a third plate bonded to, of the second plate, a surface opposite to a joint surface with the first plate, the third plate having a plurality of pressure chambers communicating with the respective through-holes, wherein a plurality of piezoelectric elements are disposed at positions corresponding to the respective pressure chambers, and pressures generated by volume changes of the respective pressure chambers in response to deformation of the respective piezoelectric elements allow liquid in the pressure chambers to be discharged through the nozzle holes in a form of the droplets, the method including: a first step to perform a surface activation process on joint surfaces of the first, second, and third plates with an atom beam, an ion beam, or a plasma as an energy wave; a second step to align and stack the first, second, and third plates in such a manner that the nozzle holes formed in the first plate communicate with the respective through-holes formed in the second plate; and a third step to bond the joint surfaces of the stacked first, second, and third plates to each other by atomic bonding without covalent bonding caused by ion movement, wherein the third step bonds the joint surfaces by bringing a load member into contact with the droplet-discharging surface of the first plate at a position away from the nozzle holes and applying a pressure to the droplet-discharging surface under an atmospheric pressure, and by bringing the joint surfaces close to each other with an electrostatic attractive force generated between the joint surfaces.

In a seventh aspect, a sum of a load applied in the third step of the sixth aspect is within a range of not less than 0.196 N and not more than 4.90 N.

In an eighth aspect, the third step of the sixth or seventh aspect is performed under a temperature of not less than 100° C. and not more than 200° C.

In a ninth aspect, the first and third plates of the sixth to eighth aspects are each made of silicon, the second plate is made of glass, and the first, second, and third plates each have a thickness of not less than 100 μm and not more than 300 μm.

In a tenth aspect, the droplet-discharging surface of the first plate of the sixth to ninth aspects has a liquid-repellent film formed thereon.

Effects of the Invention

The present invention can provide a droplet-discharging head substrate and a droplet-discharging head produced by bonding without impairing good discharge characteristics. The present invention can also minimize warps, breakages, and damage of the plates constituting the droplet-discharging head substrate when the plates are bonded to each other.

EMBODIMENT TO CARRY OUT THE INVENTION

A droplet-discharging head and a droplet-discharging head substrate according to the present invention will now be described.

Figure 1:
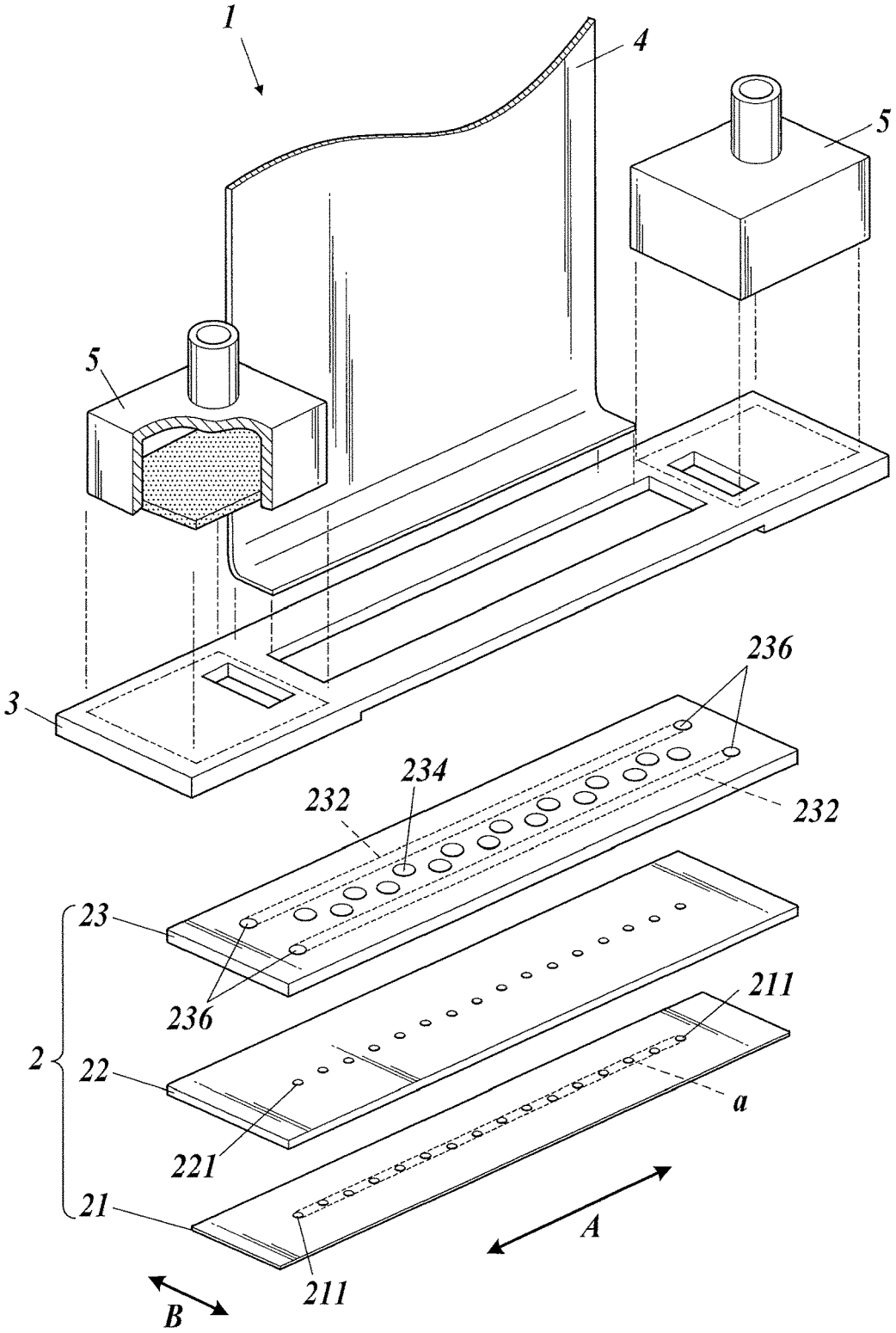
FIG. 1 is an exploded perspective view of a droplet-discharging head according to the present invention.
Figure 2:
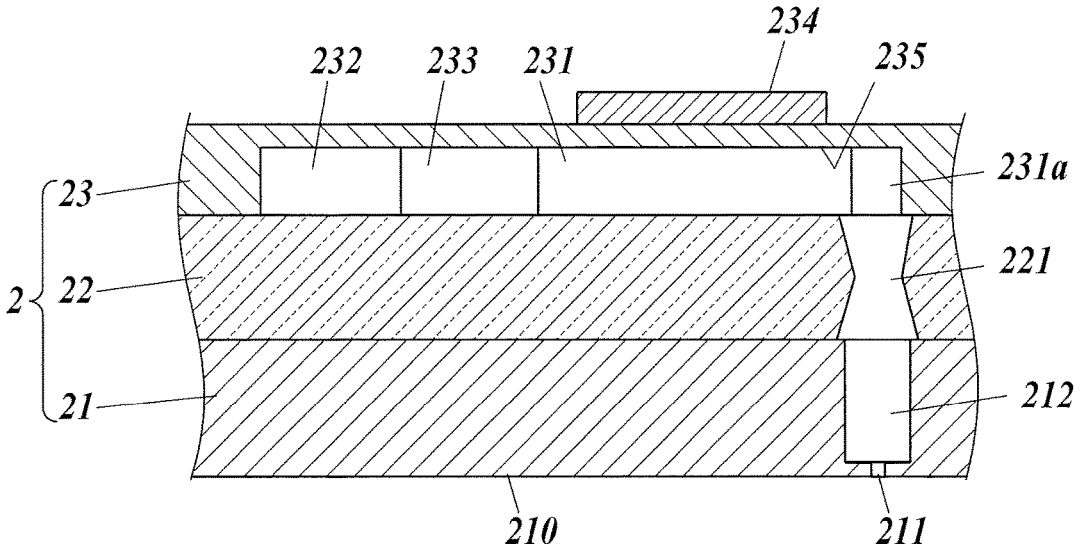
FIG. 2 is a partial cross-sectional view showing the layer configuration of a head substrate in the droplet-discharging head shown in FIG. 1.

FIG. 1 is an exploded perspective view of a droplet-discharging head according to the present invention. FIG. 2 is a partial cross-sectional view showing the layer configuration of a droplet-discharging head substrate 2 in the droplet-discharging head shown in FIG. 1.

The descriptions will now be made with reference to FIGS. 1 and 2.

In FIG. 1, the reference number 1 refers to a droplet-discharging head. The droplet-discharging head 1 includes a droplet-discharging head substrate 2, a retaining substrate 3, an external wiring member 4, and ink flow path members 5.

The droplet-discharging head substrate 2 is constituted of three plates, a nozzle plate 21 (first plate), an intermediate plate 22 (second plate), and a body plate 23 (third plate). The three plates are stacked and integrated with one another to form the droplet-discharging head substrate 2.

The nozzle plate 21 is made of an Si plate having a thickness of about not less than 100 μm and not more than 300 μm. The nozzle plate 21 has nozzle holes 211 to discharge ink droplets. The nozzle holes 211 are disposed at positions corresponding to respective communication holes 221 of the intermediate plate 22 when the plates 21 and 22 are stacked. The nozzle holes 211 are formed on the side, remote from the intermediate plate 22, of the nozzle plate 21. The nozzle plate 21 has openings (large-diameter parts 212), which correspond to the respective nozzle holes 211, on the side adjacent to the intermediate plate 22. The large-diameter parts 212 are recesses having a larger diameter than the nozzle holes 211 and communicate with the respective nozzle hole 211.

The nozzle plate 21 has a liquid-repellent film (not shown) on the plane 210 on which the nozzle holes 211 are formed (i.e., nozzle plane). The liquid-repellent film can enhance the ejection stability of the droplet-discharging head. In order to enhance the ejection stability of the droplet-discharging head, a suitable liquid-repellent film is preferably formed in accordance with the droplets to be discharged from the nozzle holes. For example, fluorine resin, such as OPTOOL is preferred if the droplets to be discharged are ink droplets.

If the droplets to be discharged are ink droplets as mentioned above, the upper temperature limit of the liquid-repellent film, such as OPTOOL, formed on the nozzle plate 21 is generally 200° C. or less. The manufacturing method according to the present invention can perform bonding to form the droplet-discharging head substrate at 200° C. or less. Thus the bonding after the formation of the above-described liquid-repellent film on the nozzle plate 21 does not impair the good liquid-repellent performance, enhancing ejection stability of the droplet-discharging head. If anodic bonding, which involves a high temperature of over the upper temperature limit of the liquid-repellent film (i.e., 200° C. or less), were used to form the droplet-discharging head substrate after the formation of the liquid-repellent film, the liquid-repellent film deteriorates, failing to provide good ejection stability of the droplet-discharging head.

The intermediate plate 22 is made of a glass plate having the same shape as the body plate 23 in a plan view and having a thickness of about not less than 100 μm and not more than 300 μm. The intermediate plate 22 has communication holes 221. When the intermediate plate 22 and the body plate 23 are stacked, the communication holes 221 are disposed at the positions corresponding to extended parts 231*a* of respective pressure chambers 231 in the body plate 23. The communication holes 221 extend through the entire thickness of the intermediate plate 22 and serve as ink flow paths at the time of ink discharge.

The body plate 23, which has a long side along the A direction in FIG. 1, is made of an Si plate having a thickness of about not less than 100 μm and not more than 300 μm. The body plate 23 is a flow-path formation plate having depressed pressure chambers 231, common flow paths 232, and ink supply paths 233. The pressure chambers 231, the common flow paths 232, and the ink supply paths 233 are formed by etching one face (the lower face in FIG. 1) of the body plate 23. The pressure chambers 231 are substantially circular in shape in a plan view. Each of the common flow paths 232 is a common groove to supply ink to a plurality of pressure chambers 231. Each of the ink supply paths 233 is a fine groove which individually communicates with a common flow path 232 and a pressure chamber 231 and supplies ink in the common flow path 232 to the pressure chamber 231.

A part of each pressure chamber 231 extends outward to form an extended part 231*a*. The extended parts 231*a* are communication sections to communicate with the communication holes 221 formed in the intermediate plate 22 described above. FIG. 1 shows the body plate 23 having sixteen pressure chambers 231 arranged in the A direction. Two common flow paths 232 are disposed with the array of the pressure chambers 231 between the two common flow paths 232. Each of the two common flow paths 232 is to supply ink to eight pressure chambers 231 (every other pressure chambers 231).

The other face (the upper face in FIG. 1) of the body plate 23 has piezoelectric elements 234 disposed thereon. The piezoelectric elements 234 are pressure generators made of, for example, PZT, disposed corresponding to the positions of the respective pressure chambers 231. Deformation of the piezoelectric elements 234 deforms the deformable walls 235 between the piezoelectric elements 234 and the pressure chambers 231 to apply pressures to the ink in the pressure chambers 231 to discharge the ink. Each of the piezoelectric elements 234 has electrodes (not shown) on its upper and lower faces. The upper electrode is an individual electrode, whereas the lower electrode is in contact with a common electrode disposed on the upper face of the body plate 23.

Each of the common flow paths 232 extends in the A direction, which is the longitudinal direction of the body plate 23. The end parts of each common flow path 232 communicate with through-holes 236, which extend through the entire thickness of the body plate 23, near the both ends of the body plate 23 in the A direction. Two through-holes 236 are arranged along the B direction, which is a short-side direction of the body plate 23 perpendicular to the A direction, at each end part of the body plate 23. Each of the through-holes 236 communicates with an end of a common flow path 232.

In the above described example, the liquid to be discharged by the droplet-discharging head is ink. The liquid according to the present invention, however, is not limited to ink. The droplet-discharging head may discharge, for example, liquid containing metal for forming semiconductor circuits as well as UV inks and water-soluble inks.

In the above described example, the head substrate is constituted of only three plate members, the nozzle plate 21, the intermediate plate 22, and the body plate 23. It should be understood, however, that the head substrate may be a stack of four or more plate members.

Figure 3:
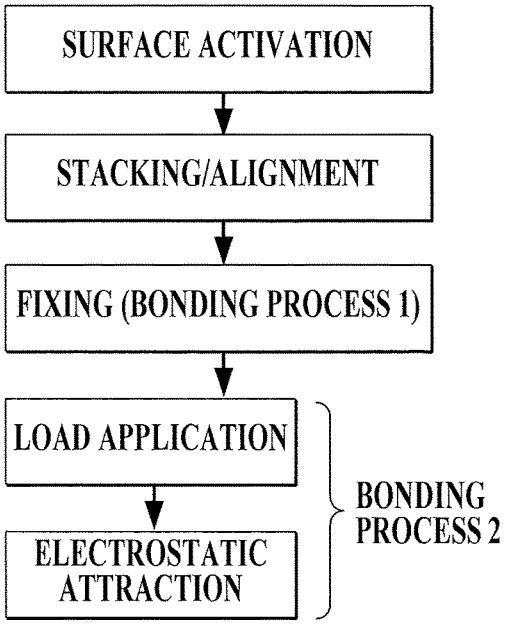
FIG. 3 is a flowchart of the method for manufacturing the head substrate according to the present invention.

The method for manufacturing the droplet-discharging head substrate according to the present invention will now be described in detail with reference to the droplet-discharging head substrate shown in FIG. 1 as an example. The manufacturing method includes the following processes (see FIG. 3).

(1) Surface activation process
(2) Stacking and alignment process
(3) Fixing process
(4) Load application process
(5) Electrostatic attraction process The processes will now be described in detail.

(1) Surface Activation Process

The surface activation process is performed by irradiation of joint surfaces with an atom beam, an ion beam, or a plasma as an energy wave. For example, the surface activation process adds OH groups or ON groups through chemical processing using a plasma, such as a nitrogen plasma or an oxygen plasma. As an alternative method, the joint surfaces may be irradiated with an Ar ion beam to be activated and then may react with water molecules in the atmosphere for OH groups to be added to the joint surfaces.

Figure 4:
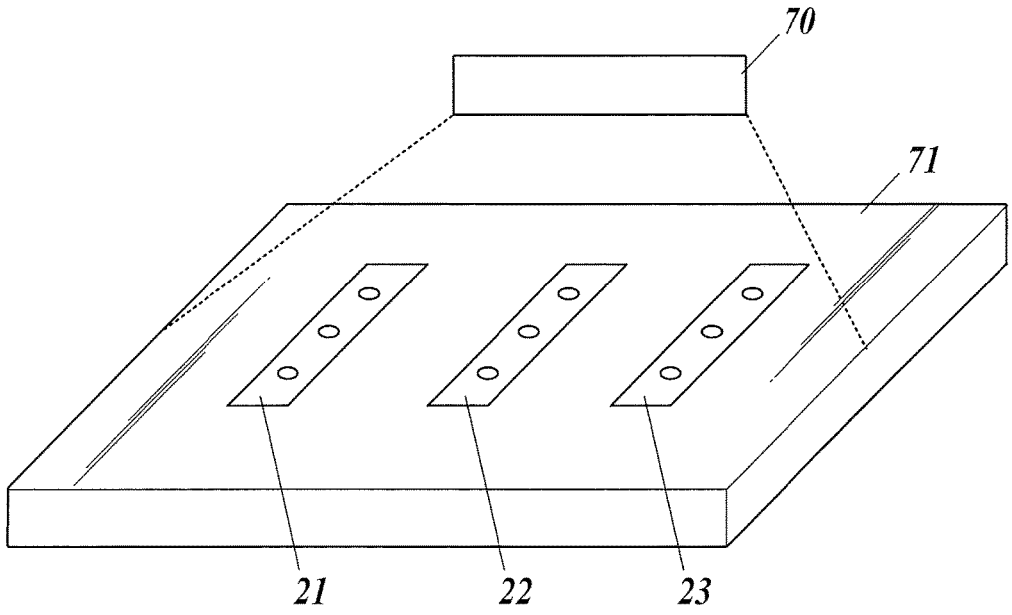
FIG. 4 is a schematic view to show a surface activation process.

In the surface activation process, the nozzle plate 21, the intermediate plate 22, and the body plate 23 are arranged on an irradiation table 71 below a plasma generator 70 under a reduced pressure, as shown in FIG. 4, for the joint surfaces to be irradiated with an oxygen or nitrogen plasma. The irradiation of plasma causes OH or ON groups to adhere to the surfaces of Si (silicon), i.e., the joint surfaces of the nozzle plate 21, the intermediate plate 22, and the body plate 23, making the joint surfaces hydrophilic.

(2) Stacking and Alignment Process

The plates on which the surface activation process has been performed are aligned in such a manner that the through-holes of the nozzle plate 21, the communication holes of the intermediate plate 22, and the through-holes of the body plate 23 communicate with each other. The plates are then stacked. The alignment process is performed by an operator handling the plates while watching alignment marks (not shown) on the corners of each plate using, for example, a CCD camera. The alignment marks are put in advance before the stacking and alignment process at such locations that the through-holes of the nozzle plate 21, the communication holes of the intermediate plate 22, and the through-holes of the body plate 23 will communicate with each other when the plates 21, 22, and 23 are stacked. Preferably, two cut holes are made at corners of each plate by etching to be used as the alignment marks.

(3) Fixing Process

The fixing process will now be described with reference to FIG. 5.

The device is constituted of a base 64, fixation members 61, support members 63, and elastic members 65. The base 64 is a place where the nozzle plate 21, the intermediate plate 22, and the body plate 23 are to be placed and to which the support members 63 are fixed. Commonly-used metal or a conductive member that does not deform in response to heat at the time of electrostatic attraction may be used as the base 64.

Figure 5A:
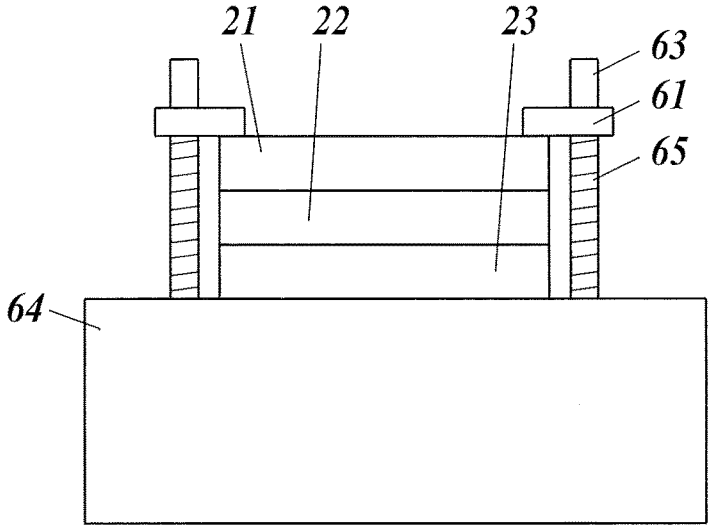
FIG. 5A is a side view to schematically show the state before application of a load for sticking the plates together.
Figure 5B:
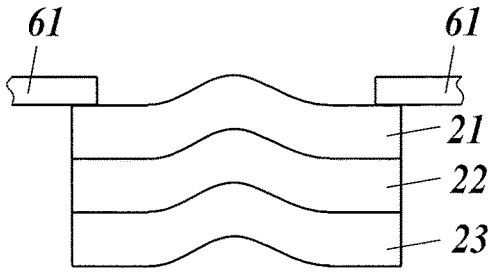
FIG. 5B is an enlarged side view of the stacked plates of FIG. 5A.
Figure 5C:
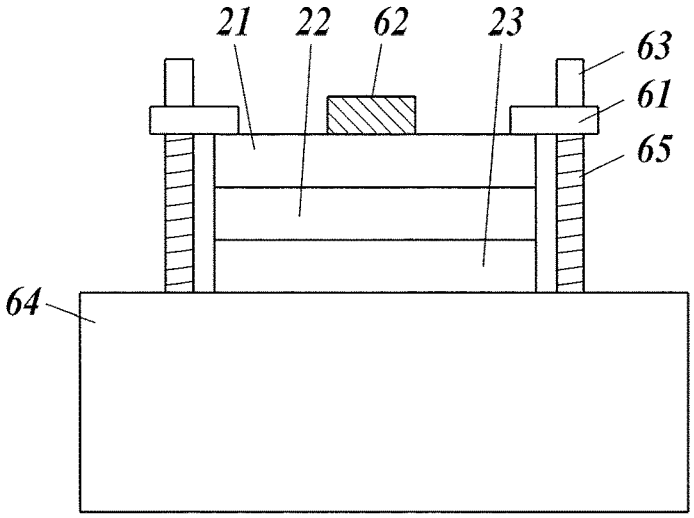
FIG. 5C is a side view to schematically show the state in which a load is applied to stick the plates together.
Figure 5D:
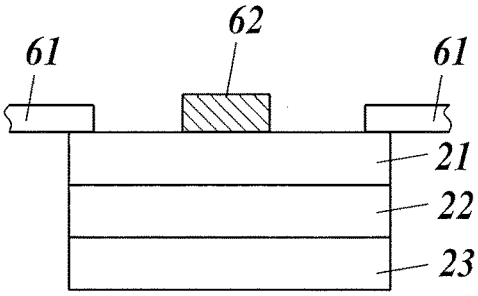
FIG. 5D is an enlarged side view of the stacked plates of FIG. 5C.

The fixation members 61 clamp the both-end parts of the nozzle plate 21, the intermediate plate 22, and the body plate 23 to fix them between the fixation members 61 and the base 64 so that the plates 21, 22, and 23 do not go out of alignment in the subsequent bonding process 2 (see FIGS. 5A and 5C). The both-end parts are outside of a nozzle-hole formation area a of the nozzle plate 21 (i.e., outside of the area formed by a plurality of nozzle holes extending in the longitudinal direction of the nozzle plate 21; see FIG. 1). The support members 63 support the fixation members 61 and include the elastic members 65. When the stack of the nozzle plate 21, the intermediate plate 22, and the body plate 23 held by the fixation members is higher than the level of the elastic members supported by the fixation members, the elastic restoring force of the elastic members 65 generates a force for pressing the nozzle plate toward the body plate. The fixation members 61 thus press the both ends of each of the stacked plates to fix the plates.

The above-described fixing process is a process where the both ends of the plates are pressed by the fixation members for fixation. The fixing process, however, may be performed through any other method that can fix the plates so that the aligned and stacked plates do not go out of alignment in the processes described later. For example, alignment frames (not shown) may be provided at two diagonal corners of the four corners of the plates to prevent a displacement in the direction perpendicular to the stacking direction.

(4) Load Application Process

The load application process is a process to mainly apply a pressure to the plates to straighten the warps of the plates. It is not that the joint surfaces are brought close to and bonded to each other in this process alone, but that this process brings the joint surfaces of the plates close enough for the bonding to each other in combination with the electrostatic attraction described later.

If a load is applied to the whole surface of the plate, the warps can naturally be straightened. If, however, a load is applied to the whole surface of the plate, the nozzle-hole formation area a is subjected to the load, leading to damage of the nozzle-hole formation area a. In view of this, load members are placed on an area away from the nozzle-hole formation area a in such a manner that a load is evenly applied to the area away from the nozzle-hole formation area a, as shown in FIG. 7. If the load members are disposed so as to evenly apply a load to the area away from the nozzle-hole formation area a, an inherent convex warp in the center of each plate can be straightened with less load. Since the contact area between the load members and the nozzle plate is reduced as described above, the nozzles are not subject to damage that would affect the discharge characteristics. Further, the load application process performed under the atmospheric pressure can let air escape through the through-holes at the time of bonding. This allows the joint surfaces to come close to each other to achieve bonding necessary for the manufacture of the droplet-discharging head substrate. The load that can straighten the warps of the members themselves is enough. The load required to straighten the warps of the members themselves varies depending to the thicknesses of the members. For example, a pressure of not less than 0.196 N and not more than 4.90 N is preferably applied to the plates when each of the plates has a thickness of not less than 100 μm and not more than 300 μm and has a surface area of not less than 480 $mm^2$ and not more than 550 $mm^2$. Thus, the load to straighten the warp inherent in each plate can be reduced and damage to the nozzles and breakages of the plates can be prevented.

Figure 7A:
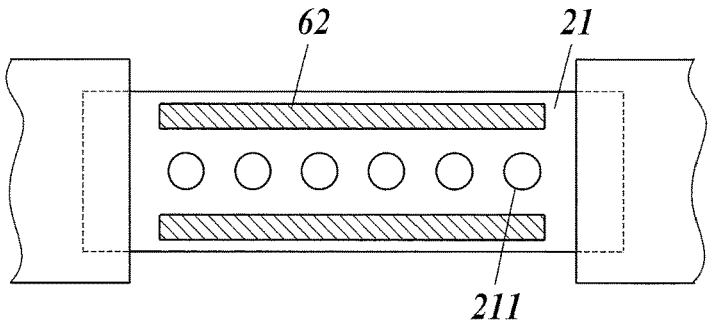
FIG. 7A is atop view schematically showing the configuration with load members applied to stick the plates together.
Figure 7B:
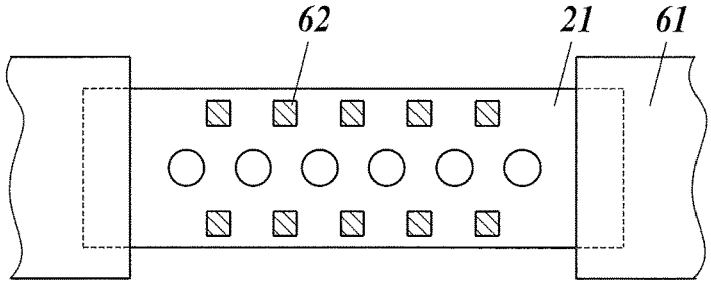
FIG. 7B is a top view schematically showing the configuration with load members applied to stick the plates together.
Figure 7C:
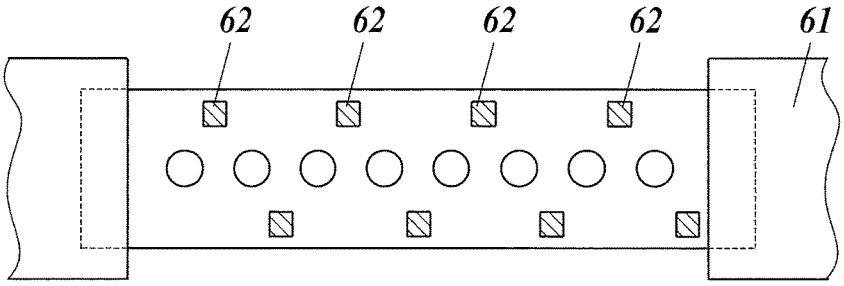
FIG. 7C is a top view schematically showing the configuration with load members applied to stick the plates together.

There are various layouts of load members 62 that can straighten the warps and where the load members 62 are disposed away from the nozzle-hole formation area a as shown in FIGS. 7A to 7C. In particular, the layout of FIG. 7A is preferred in that plate-like load members 62 disposed in such a manner as to avoid the nozzle-hole formation area a can apply a load evenly to the area away from the nozzle-hole formation area a. The layout of FIG. 7B is preferred in that a load is evenly applied to the area away from the nozzle-hole formation area a while the contact area between the load members and the nozzle plate is minimized. The layout of FIG. 7C, where the load members 62 are arranged in a zigzag fashion with the nozzle-hole formation area a therebetween, is more preferred in that a load is evenly applied to the area away from the nozzle-hole formation area a and in that the contact area between the load members and the nozzle plate is smaller compared to the layout of FIG. 7B.

Figure 6:
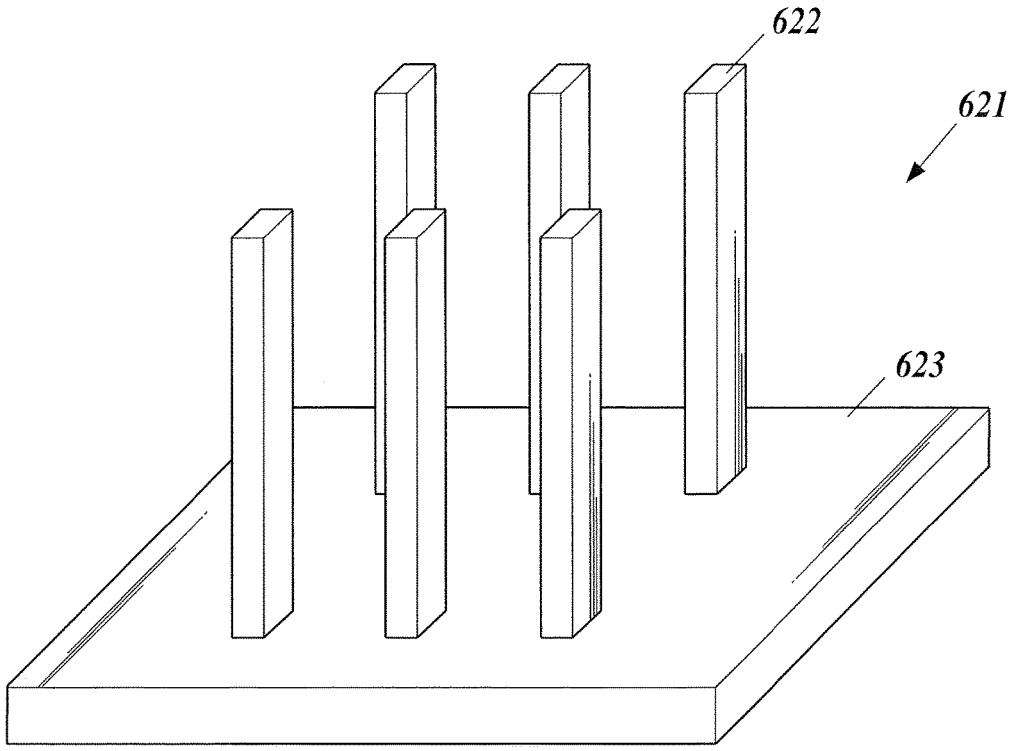
FIG. 6 is a schematic view of a needle load member.

The load members 62 may be made of various types of material, such as commonly-used metal. Each of the load members may have a plate-like shape as shown in FIG. 7A. Alternatively, in the case of high-density openings, a needle load member 621 as shown in FIG. 6 may be disposed in such a manner as not to touch the openings. The needle load member 621 is constituted of needle parts 622 and a base part 623. The needle parts 622 and the base part 623 are preferably made of material, such as metal, that does not deform due to heat applied at the time of electrostatic attraction. The needle load member 621 is designed so that the load members can be evenly placed on the area away from the nozzle-hole formation area a in accordance with the arrangement pattern of the nozzle openings. Such a needle load member 621 can collectively apply the load members, leading to enhanced production efficiency than in the case in which a plurality of load members are placed one by one. In particular, such a needle load member 621 is preferably used for a nozzle plate having high-density nozzles which requires a load member to be finely divided so that a load is applied evenly to the area away from the nozzle-hole formation area a.

(5) Electrostatic Attraction Process

The electrostatic attraction will now be described in detail with reference to FIG. 8.

In the bonding process according to the present invention, it is necessary to bring the nozzle plate 21, the intermediate plate 22, and the body plate 23 close to each other for OH or ON groups added to the joint surfaces to bond to one another by the Van der Waals force at the molecular level while straightening the warps of the plates 21, 22, and 23 with the load members 62.

Figure 8:
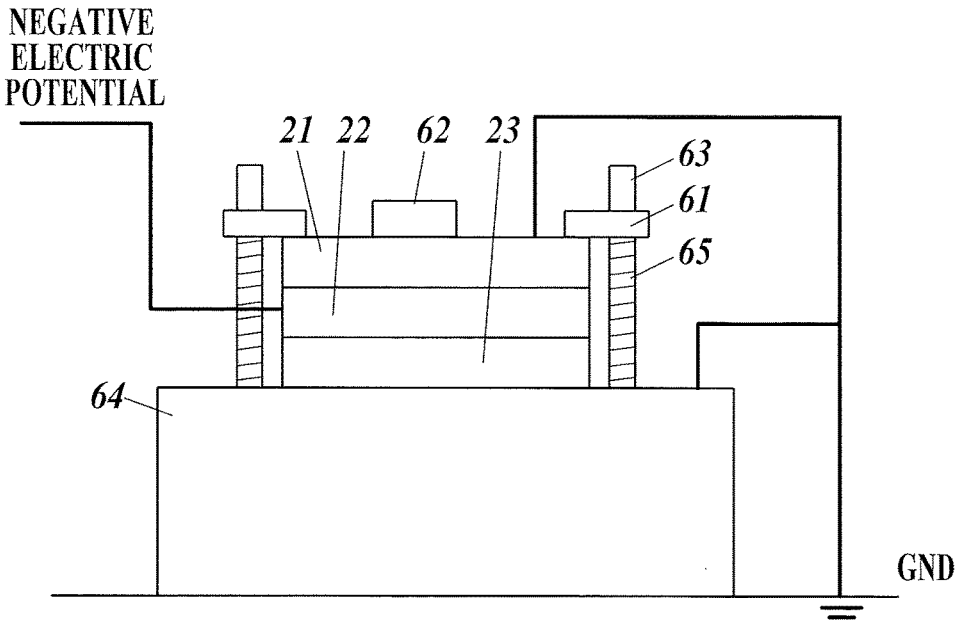
FIG. 8 is a schematic view to show electrostatic attraction.
Figure 9:
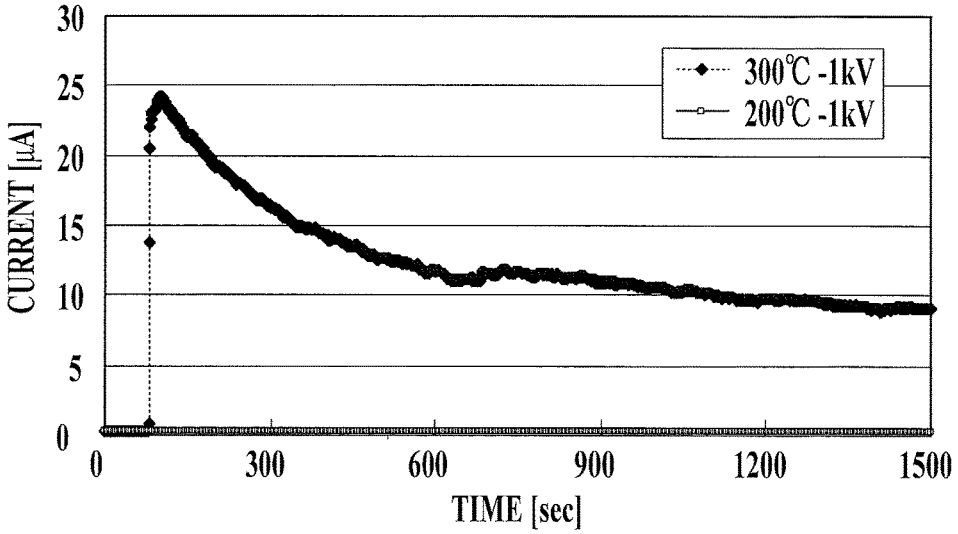
FIG. 9 shows changes in cation movement depending on temperature.

In view of this, as shown in FIG. 8, the intermediate plate 22 is connected to a negative electric potential, and the nozzle plate 21 and the body plate 23 are connected to the GND. Thus the intermediate plate 22 has a lower electric potential than the nozzle plate 21 and the body plate 23, while the nozzle plate 21 and the body plate 23, which are connected to the GND, have a higher electric potential. The difference in electric potential generates an electrostatic attractive force for the molecules on one plate to come close to the molecules on another plate in the stacked plates.

The electrostatic attractive force consequently causes the plates to attract each other, and the air remaining in the gaps is discharged through the flow paths extending from the body plate to the nozzles. This causes the plates to come as close to each other as a distance of several hundred nm. When the plates are brought as close to each other as a distance of several hundred nm, the Van der Waals force causes OH or ON groups to come into contact with each other at the molecular level to create hydrogen bonds and enables the surface activated bonding. If the plates have small surface roughness that creates gaps between the plates, the bonding is preferably performed under the condition of not less than 100° C. and not more than 200° C. When the joint surfaces of the plates are softened under not less than 100° C. and not more than 200° C. and the plates are brought closer to each other by an electrostatic attraction, the gaps between the softened joint surfaces of the plates are filled, achieving the bonding with high adhesion.

That is, the electrostatic attraction according to the present invention removes the gaps between the plates using an electrostatic attractive force without the need for contact with the members and brings the plates close to each other enough for the subsequent bonding of the plates by atomic bonding. The electrostatic attraction does not require a high pressure for bonding that would be necessary for typical surface activated bonding. The electrostatic attraction in combination with the load application process, which is a previous step, can minimize the breakages, warps, and damage of the surfaces of the plate members.

The electrostatic attraction is performed under the condition of direct-current high voltage of not less than 500 V and not more than 2000 V and under ordinary pressure. Further, while anodic bonding requires a high voltage and a temperature of at least 250° C., the bonding using the electrostatic attraction can be performed at a lower temperature and thus can prevent the plates from warping again. Specifically, the bonding using the electrostatic attraction can be performed under a temperature of not less than 100° C. and not more than 200° C. even if the plate surfaces have small roughness as described above.

The combination of the load application process and the electrostatic attraction process of the bonding process 2, where load members necessary for straightening warps are placed at such positions as not to damage the nozzles and where the gaps formed due to the small roughness between the plates are filled using the electrostatic attraction, can bond the plates to each other in such a manner as to minimize the warps, breakages, and damage of the plates constituting the droplet-discharging head substrate.

Further, the use of an electrostatic attractive force without involving ion movement, as described above, enables the bonding without the need for expensive glass for anodic bonding, such as borosilicate glass (TEMPAX glass) and glass for anodic bonding of SW series, as the intermediate plate 22. Examples of glass, other than the glass for anodic bonding, which is applicable to the bonding method according to the present invention include soda-lime glass. Such soda-lime glass is lower in price than the glass for anodic bonding, leading to reduction in manufacturing cost.

A surface activation process and a layout of load members of the present invention are not limited to those of the above-described embodiment. In the embodiment, the bonding method according to the present invention is used for all the bonding of the joint surfaces of the nozzle plate, the intermediate plate, and the body plate for sake of simplicity. The present invention, however, is not limited to this. For example, the scope of the present invention also includes a case in which the nozzle plate and the intermediate plate are bonded to each other in the bonding method according to the present invention whereas the intermediate plate and the body plate are bonded to each other in a conventional bonding method, such as adhesion bonding or anodic bonding, to form a droplet-discharging head substrate.

INDUSTRIAL APPLICABILITY

The present invention is applicable to a field of manufacturing droplet-discharging head substrates and droplet-discharging heads to discharge liquid from nozzle holes.

The invention claimed is:

1. A method for manufacturing a droplet-discharging head substrate, the substrate comprising a first plate having a plurality of nozzle holes to discharge droplets; and a second plate bonded to a surface of the first plate opposite to a droplet-discharging surface from which the droplets are discharged, the second plate having a plurality of through-holes communicating with the respective nozzle holes to form a plurality of flow paths, the method comprising:

a first step comprising performing a surface activation process on surfaces to be joined of the first and second plates with an atom beam, an ion beam, or a plasma as an energy wave;

a second step comprising aligning and stacking the first and second plates in such a manner that the nozzle holes formed in the first plate communicate with the respective through-holes formed in the second plate; and a third step comprising bonding the surfaces to be joined of the stacked first and second plates to each other by atomic bonding without covalent bonding caused by ion movement, wherein the third step comprising bonding the surfaces to be joined by bringing a load member into contact with the droplet-discharging surface of the first plate at a position away from the nozzle holes and applying a pressure to the droplet-discharging surface under an atmospheric pressure, and by bringing the surfaces to be joined close to each other with an electrostatic attractive force generated between the surfaces to be joined.

2. The method for manufacturing the droplet-discharging head substrate according to claim 1, wherein a sum of a load applied in the third step is within a range of not less than 0.196 N and not more than 4.90 N.

3. The method for manufacturing the droplet-discharging head substrate according to claim 1, wherein the third step is performed under a temperature of not less than 100° C. and not more than 200° C.

4. The method for manufacturing the droplet-discharging head substrate according to claim 1, wherein the first plate is made of silicon, the second plate is made of glass, and the first and second plates each have a thickness of not less than 100 μm and not more than 300 μm.

5. The method for manufacturing the droplet-discharging head substrate according to claim 1, further comprising a liquid-repellent film formed on the droplet-discharging surface of the first plate.

6. A method for manufacturing a droplet-discharging head, the head comprising a first plate having a plurality of nozzle holes to discharge droplets; a second plate bonded to a surface of the first plate opposite to a droplet-discharging surface from which the droplets are discharged, the second plate having a plurality of through-holes communicating with the respective nozzle holes to form a plurality of flow paths; and a third plate bonded to a surface of the second plate opposite to a joint surface with the first plate, the third plate having a plurality of pressure chambers communicating with the respective through-holes, wherein a plurality of piezoelectric elements are disposed at positions corresponding to the respective pressure chambers, and pressures generated by volume changes of the respective pressure chambers in response to deformation of the respective piezoelectric elements allow liquid in the pressure chambers to be discharged through the nozzle holes in a form of the droplets, the method comprising:

a first step comprising performing a surface activation process on surfaces to be joined of the first, second, and third plates with an atom beam, an ion beam, or a plasma as an energy wave;

a second step comprising aligning and stacking the first, second, and third plates in such a manner that the nozzle holes formed in the first plate communicate with the respective through-holes formed in the second plate; and a third step comprising bonding the surfaces to be joined of the stacked first, second, and third plates to each other by atomic bonding without covalent bonding caused by ion movement, wherein the third step comprises bonding the surfaces to be joined by bringing a load member into contact with the droplet-discharging surface of the first plate at a position away from the nozzle holes and applying a pressure to the droplet-discharging surface under an atmospheric pressure, and by bringing the surfaces to be joined close to each other with an electrostatic attractive force generated between the surfaces to be joined.

7. The method for manufacturing the droplet-discharging head according to claim 6, wherein a sum of a load applied in the third step is within a range of not less than 0.196 N and not more than 4.90 N.

8. The method for manufacturing the droplet-discharging head according to claim 6, wherein the third step is performed under a temperature of not less than 100° C. and not more than 200° C.

9. The method for manufacturing the droplet-discharging head according to claim 6, wherein the first and third plates are each made of silicon, the second plate is made of glass, and the first, second, and third plates each have a thickness of not less than 100 μm and not more than 300 μm.

10. The method for manufacturing the droplet-discharging head according to claim 6, further comprising a liquid-repellent film formed on the droplet-discharging surface of the first plate.

* * * * *